US009915024B2

(12) United States Patent
Chua et al.

(10) Patent No.: US 9,915,024 B2
(45) Date of Patent: Mar. 13, 2018

(54) HAND-HELD STEAMER HEAD

(71) Applicant: KONINKLIJKE PHILIPS N.V., Eindhoven (NL)

(72) Inventors: Hee Keng Chua, Eindhoven (NL); Luck Wee Png, Eindhoven (NL); Mahesh Gurumalliah Areuyr, Eindhoven (NL); Siew Hon Loke, Eindhoven (NL); Sahil Wadhwa, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/911,770

(22) PCT Filed: Aug. 20, 2014

(86) PCT No.: PCT/EP2014/067694
§ 371 (c)(1),
(2) Date: Feb. 12, 2016

(87) PCT Pub. No.: WO2015/028359
PCT Pub. Date: Mar. 5, 2015

(65) Prior Publication Data

US 2016/0194816 A1 Jul. 7, 2016

(30) Foreign Application Priority Data

Aug. 26, 2013 (EP) ..... 13181682

(51) Int. Cl.
*D06F 87/00* (2006.01)
*D06F 75/38* (2006.01)
*D06F 75/20* (2006.01)

(52) U.S. Cl.
CPC ..... *D06F 87/00* (2013.01); *D06F 75/20* (2013.01); *D06F 75/38* (2013.01)

(58) Field of Classification Search
CPC ..... D06F 87/00; D06F 73/00; D06F 75/38; D06F 75/18; D06F 75/16; D06F 75/20; D06F 75/30; D06F 79/00
USPC ..... D32/17, 25
See application file for complete search history.

(56) References Cited

U.S. PATENT DOCUMENTS 3,675,449 A * 7/1972 Bluestein ..... D06F 87/00 15/176.3
6,513,269 B2 2/2003 Kobayashi
7,155,117 B2 * 12/2006 Leung ..... D06F 73/00 219/245

(Continued)

FOREIGN PATENT DOCUMENTS

CN 202107921 U 1/2012
CN 202298268 U 7/2012

(Continued)

*Primary Examiner* — Ismael Izaguirre

(57) ABSTRACT

The present application relates to a hand-held steamer head for a fabric steamer. The hand-held steamer head has a body (2) with one or more steam vents (9) and a friction surface (23) for locating against a fabric to be steamed. The friction surface (23) is configured to act on the fabric to resist movement of the fabric relative to the body (2) as the body (2) is drawn over the fabric. The present invention also relates to a fabric steamer having a hand-held steamer head and a hand-held steamer head kit.

20 Claims, 4 Drawing Sheets

(56) References Cited

U.S. PATENT DOCUMENTS

| | | | | |
|---|---|---|---|---|
| 7,188,442 | B2 * | 3/2007 | Fernandez | D06F 75/14 38/81 |
| 7,640,686 | B2 * | 1/2010 | Wai | D06F 71/02 38/81 |
| 7,661,212 | B2 * | 2/2010 | Hahn | D06F 75/10 210/282 |
| 2004/0010950 | A1 | 1/2004 | Leung | |
| 2004/0144140 | A1 * | 7/2004 | Lee | D06F 73/00 68/222 |
| 2010/0058623 | A1 | 3/2010 | Fernandez | |

FOREIGN PATENT DOCUMENTS

| | | | |
|---|---|---|---|
| CN | 202323512 | U | 7/2012 |
| FR | 2978360 | A1 | 2/2013 |
| WO | 2012066473 | A2 | 5/2012 |

* cited by examiner

HAND-HELD STEAMER HEAD

This application is the U.S. National Phase application under 35 U.S.C. § 371 of International Application No. PCT/EP2014/067694, filed on Aug. 20, 2014, which claims the benefit of International Application No. 13181682.9 filed on Aug. 26, 2013. These applications are hereby incorporated by reference herein.

FIELD OF THE INVENTION

The present invention relates to a hand-held steamer head for a fabric steamer. The present invention also relates to a fabric steamer comprising a hand-held steamer head.

BACKGROUND OF THE INVENTION

Garment steamers are known for steaming garments to remove creases from a fabric material of a garment through the use of heat and moisture. Such a garment steamer generally comprises a steam generating unit and a hand-held steamer head connected to the steam generating unit by a flexible hose through which steam is conveyed to the steamer head. The steamer head is provided with one or more steam vents to discharge steam onto the fabric being treated. Typically, the garment is hung on a hanger during treatment by the steamer and the user positions the steamer head over the garment to remove creases. Such a steamer head is disclosed in US 2004/010950 and comprises a soleplate and a handle. The user grips the handle to position the soleplate over the section of fabric to be treated. However, such a garment steamer may be inefficient at crease removal which may increase the time and energy required to remove creases from a garment.

SUMMARY OF THE INVENTION

It is an object of the invention to provide a hand-held steamer head for a fabric steamer, a hand-held steamer head kit and a fabric steamer comprising a hand-held steamer head which alleviates or overcomes the problems mentioned above.

The invention is defined by the independent claims; the dependent claims define advantageous embodiments.

According to an aspect of the present invention, there is provided a hand-held steamer head for a fabric steamer, the hand-held steamer head comprising a body with one or more steam vents and a friction surface for locating against a fabric to be steamed, the friction surface being configured to act on said fabric in which it is in contact, to resist movement of the fabric relative to the body as the body is drawn over said fabric. As the fabric is resisted from moving relative to the body by the friction surface, the fabric is under tension when a portion of the fabric is held in a fixed position and the body is drawn over the fabric. Therefore, the section of fabric between the portion held in a fixed position and the portion which is acted on by the friction surface is in tension as steam is applied to it, which enhances the ability of the hand-held steamer head to remove creases from the fabric by straightening out the creases while the fabric is treated by steam.

In one embodiment, the body comprises a front end, and the friction surface and the one or more steam vents are on the front end. The hand-held steamer may further comprise a handle that is configured to orientate the front end of the body so that the fabric is drawn against the friction surface prior to passing proximate to the one or more steam vents when the body is drawn over the fabric. Such an arrangement allows for the friction surface to be drawn across the fabric prior to the one or more steam vents being drawn across the fabric, so that when the body is drawn over the fabric a section of the fabric is put under tension prior or during treatment with steam.

In one embodiment, the hand-held steamer head comprises a friction member to form the friction surface, and the friction member may protrude from the front end of the body. Such an arrangement helps the fabric to come into contact with the friction surface when the body is drawn across the fabric. In an alternate embodiment, the friction surface is formed by the front end of the body. Such an arrangement may reduce the number of components required to manufacture the hand-held steamer head.

In one embodiment, the friction surface has a friction coefficient to cotton fabric of greater than or equal to 0.6, and preferably greater than 1.0, and optionally the friction surface is formed from rubber. A greater friction coefficient between the fabric and the friction surface means that the tension of the fabric as the hand-held steamer head is moved down the fabric is increased, and so the ability of the hand-held steamer head to remove creases from the fabric is improved. In one embodiment, the friction surface is formed by spray coating the hand-held steamer head with rubber. In another embodiment, the friction surface comprises a portion of rubber that is insert molded to the hand-held steamer head.

In one embodiment, the friction surface is removably mounted to the body. In such an embodiment, the friction surface may be replaced when the friction surface becomes worn, or may be interchanged with an alternate friction surface to suit to a different fabric to be steamed. Furthermore, removal of the friction surface may make cleaning of the hand-held steamer head and the friction surface easier.

In one embodiment, the hand-held steamer head further comprises a fabric attraction unit configured to draw the fabric against the body. This may help steam vented from the steam outlet to be expelled from the steam vents directly against the fabric and to be forced through the fabric or between the fabric and the body. Furthermore, the fabric attraction unit may exert a force on the fabric to urge the fabric against the friction surface, which will increase the tension of the fabric as the body is drawn over the fabric. In one such embodiment, the friction surface is disposed between the one or more steam vents and the fabric attraction unit. This allows for a section of the fabric to be held against the friction surface and the friction surface drawn across the fabric prior to the steam outlet being drawn across the fabric, so that when the body is drawn over the fabric a section of the fabric is put under tension prior or during treatment with steam.

In one embodiment, the friction surface is configured to exert a stretching force on the fabric which is dependent on the force that the fabric is urged against the body by the fabric attraction unit and the friction coefficient between the friction surface and the fabric, wherein when the fabric is cotton the stretching force is between 120 gf (1.17N) and 250 gf (2.45N) when the hand-held steamer head is drawn over the fabric. A stretching force that is in the range of 120 gf (1.17N) to 250 gf (2.45N) facilitates effective removal of wrinkles from the cotton and avoids the appearance of stretch marks on the cotton.

In one embodiment, the fabric attraction unit comprises a suction unit having an air inlet. Such an embodiment allows for air to be sucked in through the air inlet to create a low pressure at the air inlet to draw the fabric against the body.

Therefore, steam vented from the steam outlet may be expelled from the steam vents directly against the fabric and may be forced through the fabric or between the fabric and the body.

In an alternate embodiment, the fabric attraction unit comprises an electrostatic generator. Such an embodiment allows for the fabric to be drawn against the body by electrostatic attraction so that steam vented from the steam outlet may be expelled from the steam vents directly against the fabric and may be forced through the fabric or between the fabric and the body.

In one embodiment, the hand-held steamer head comprises two friction surfaces. Such an arrangement may increase the friction coefficient between the fabric and the body of the hand-held steamer head.

According to another aspect of the present invention, there is provided a fabric steamer comprising a hand-held steamer head according to an aspect of the invention.

According to another aspect of the present invention, there is also provided a hand-held steamer head kit according to an aspect of the invention and two or more friction members interchangeably mountable to the body.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Figure 1:
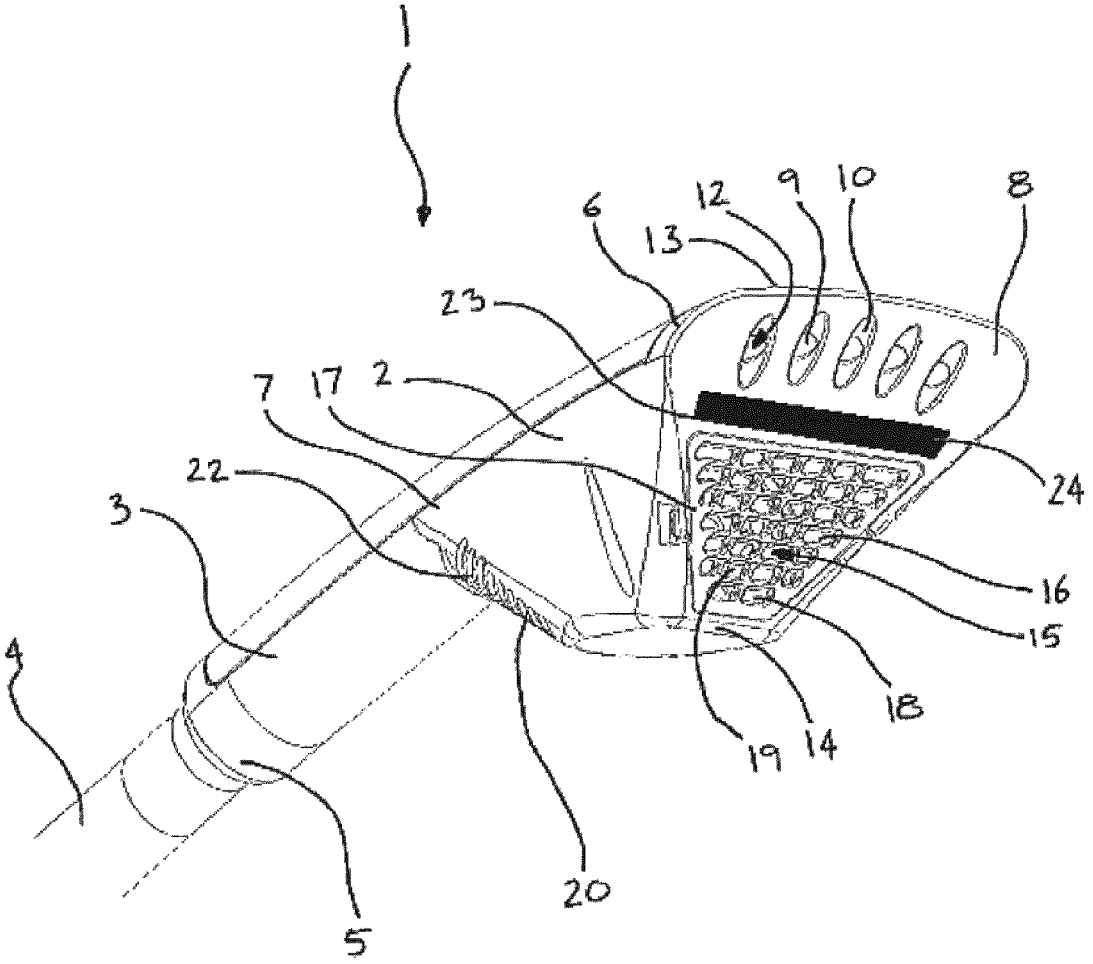
FIG. 1 shows a perspective view of a hand-held steamer head for a fabric steamer.
Figure 2:
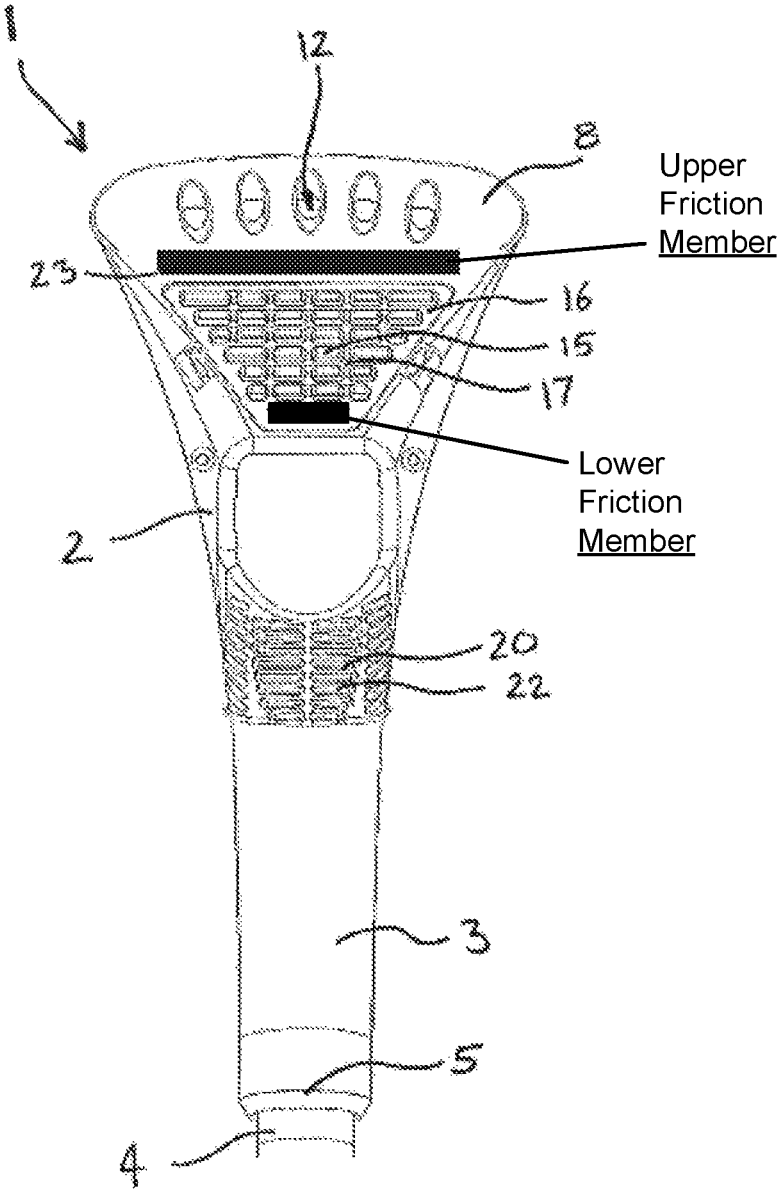
FIG. 2 shows a perspective view from below of the hand-held steamer head shown in FIG. 1.
Figure 3:
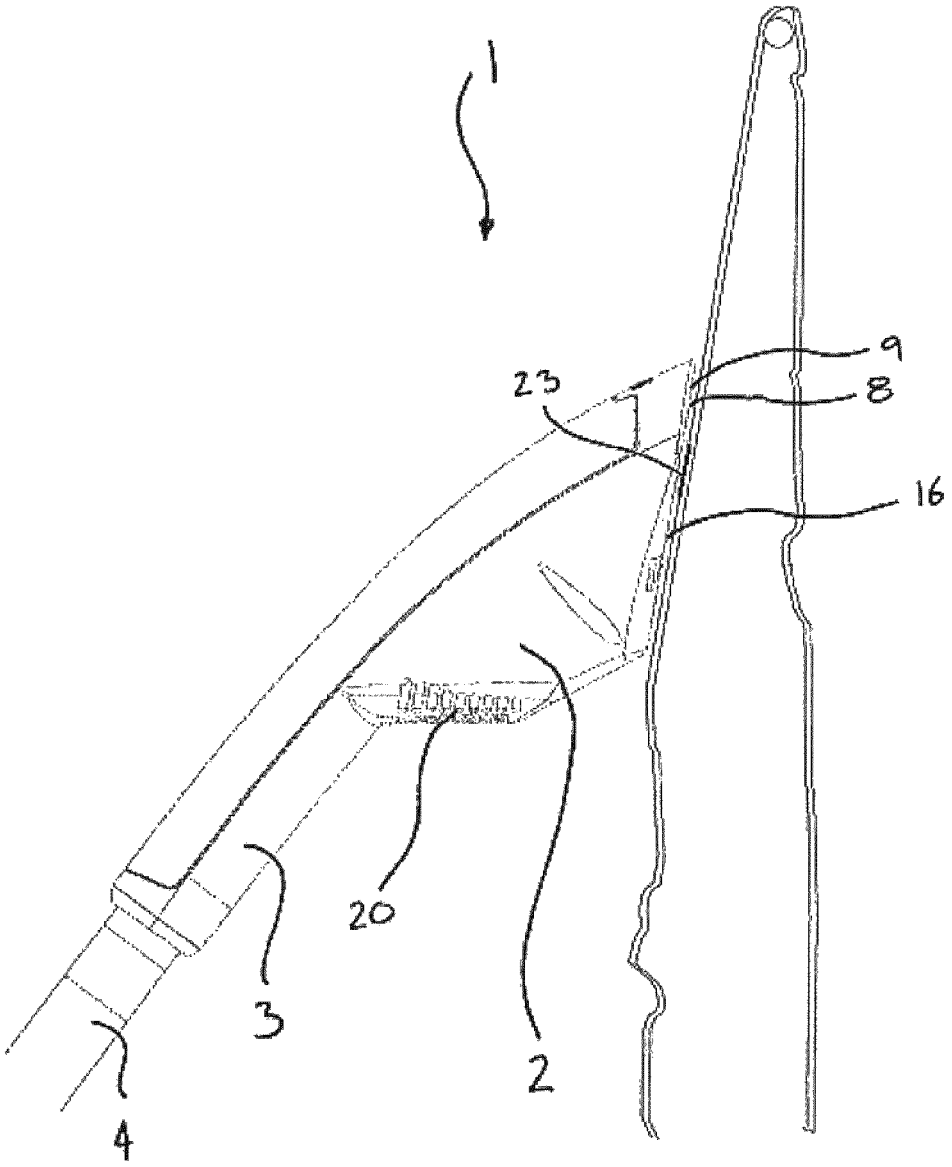
FIG. 3 shows a side view of the hand-held steamer head shown in FIG. 1, located against a fabric.

Referring now to FIGS. 1 to 3, a hand-held steamer head 1 for a fabric steamer is shown. The hand-held steamer head 1 forms a nozzle which comprises a body 2 with a handle 3 extending therefrom. A flexible hose 4 extends from the handle 3 at a distal end 5 to the body 2. The flexible hose 4 extends between the steamer head 1 and a base unit (not shown) with a steam generation unit (not shown), acting as a steam generating means, so that steam generated in the steam generation unit flows through the flexible hose 4 and is provided to the steamer head 1.

The body 2 and the handle 3 are integrally formed. The body 2 of the steamer head 1 has a front end 6 and a rear end 7. The handle 3 extends from the rear end 7 of the body 2. The front end 6 of the body 2 has a front face 8. In the present embodiment, the body 2 and handle 3 are formed from a heat resistant moulded plastic.

Steam vents 9 are formed through the front face 8 of the body 2. The steam vents 9 act as a steam outlet 10. The steam vents 9 communicate the front face 8 with a steam path 12 in the steamer head 1. The steam path 12 extends between the steam vents 9 at the front end 6 of the body 2 and a steam inlet (not shown) at the distal end 5 of the handle 3. The steam inlet communicates with the hose 4. The handle 3 extends at an angle downwardly from the body 2, such that it extends at an acute angle to the front face 8 of the body 2.

The front face 8 of the body 2 comprises an upper edge 13 and a lower edge 14.

The flexible hose 4 is releasably mounted to the steam inlet (not shown) to provide steam to the steamer head 1. The steam path 12 extending between the steam inlet and the steam outlet 10 defines a steam passageway along which steam flows. Each steam vent 9 communicates the steam path 12 with the front face 8 of the body 2. Although an array of steam vents 9 form the steam outlet 10 in the present embodiment, it will be appreciated that the steam outlet 10 may be a single steam vent.

The steamer head 1 comprises a suction unit 15. The suction unit 15 acts as a fabric attraction unit. The suction unit 15 is configured to draw a fabric against the body 2, in particular the front face 8. The suction unit 15 has an air inlet 16. The air inlet 16 fluidly communicates with an air suction means comprising an axial fan (not shown).

The air inlet 16 is on the front end 6 of the body 2 and is formed on the front face 8 of the body 2. The air inlet 16 extends substantially across the front face 8. The air inlet 16 has a grill 17 extending across its opening which forms a number of apertures 18. The steam vents 9 are at the upper end of the front end 6 of the body 2 proximate the upper edge 13 of the front face 8. The air inlet 16 is proximate a lower end of the front end 6 of the body 2, proximate the lower edge 14 of the front face 8.

The air inlet 16 communicates the front face 8 of the body 2 with an air channel 19 formed in the body 2. The air channel 19 is disposed below the steam path 12. The air channel 19 extends from the air inlet 16 at the front end 6 of the body 2 to an air outlet 20 at the rear end 7 of the body 2. The air outlet 20 comprises an outlet grill 22 formed in the rear end 7 of the body 2, below the handle 3. The air channel 19 forms an air passageway through which air sucked in through the air inlet 16 flows to and out of the air outlet 20.

The suction unit 15 draws air through the air inlet 16 into the air channel 19 and exhausts it through the air outlet 20. Therefore, a suction effect is generated at the air inlet 16 to cause a low pressure at the front end 6 of the body 2. The suction unit 15 is driven by an electric motor (not shown) and powered by a battery (not shown) disposed in the body 2, or by mains power means connected by an electric cable (not shown) which extends along the flexible hose 4. Although the air suction means is an axial fan in the present embodiment, it will be appreciated that alternative air suction means may be used to draw air in through the air inlet 16, for example, a centrifugal fan.

A friction surface 23 is disposed at the front end 6 of the body 2. The friction surface 23 is formed by a friction member 24. The friction member 24 is on the front face 8 of the body 2. The friction surface 23 extends between the steam outlet 10 and the air inlet 16. The friction surface 23 extends substantially across the front face 8. The friction member 24 is integrally formed with the steamer head 1. In one alternative, the friction member 24 is adhered to a surface of the steamer head 1 by an adhesive. Alternatively, the friction member 24 is removably mounted to the body 2. Therefore, the friction member 24 may be replaced by the user if it becomes worn. The friction member 24 is an elongated pad. However, the arrangement of the friction member 24 may vary.

The friction member 24 is configured to have is a high friction coefficient, of at least 0.6, preferably to be more than 1.0, between the friction member and the fabric of the garment to be steamed. This may be achieved by manufacturing the friction member 24 from a high friction material. For example, if the garment to be steamed is cotton, nylon, silk, or polyester then the high friction coefficient may be achieved by manufacturing the friction member 24 from a high-friction material, such as, elastomer or another high-friction polymer, for example, santoprene thermoplastic vulcanizate.

Operation buttons (not shown) on the body 2 actuate the steam generating means and the air suction means so as to cause the flow of steam out of the steam vents 9 and the flow of air into the air inlet 16. The flow of steam out of the steam vents 9 and the flow of air into the air inlet 16 may be operated independently or concurrently.

Operation of the garment steamer according to the above exemplary embodiment will now be described with reference to FIGS. 1 to 3.

A user holds the steamer head 1 by the handle 3 with the front end 6 of the body 2 extending away from the user's body. The arrangement of the handle 3 and body 2, with the handle 3 extending downwardly at an angle away from the body 2, means that in a correct holding position the steam vents 9 are disposed above the air inlet 16.

To remove creases from the fabric of a garment, the user hangs the garment from a garment hanger, such that the fabric of the garment hangs from the garment hanger in a vertical orientation, and locates the steamer head 1 against the fabric. However, it will be appreciated that the garment may be arranged and supported in other orientations.

Once the steamer head 1 is positioned against the fabric, the user actuates the steam generating unit (not shown) and the suction unit 15. Upon operation, steam generated by the steam generation unit (not shown) is supplied to the steam inlet. The steam then flows along the steam path 12 to the steam outlet 10 and flows out of the plurality of steam vents 9 towards the fabric disposed proximate thereto.

The suction unit 15 is operated to create a flow of air in the air channel 19, such that air is sucked in through the air inlet 16 and exhausted through the air outlet 20. Therefore, a low pressure is created at the air inlet 16 and the fabric of the garment is drawn against the front face 8 of the body 2. Steam vented from the steam outlet 10 is therefore expelled from the steam vents 9 directly against the fabric and is forced through the fabric or between the fabric and the front face 8. Furthermore, as the air inlet 16 is spaced from the steam vents 9, the steam is not drawn into the air inlet 16 and does not travel to the air outlet 20. An advantage of this arrangement is that steam-laden air does not pass through the fan and is not exhausted towards the user. In addition, the air outlet 20 is disposed away from the air inlet 16, and so air is not exhausted back towards the fabric of a garment and does not urge the fabric away from the front end 6 of the body 2.

The user then draws the steamer head 1 along the fabric in a downwardly acting motion in the direction of the lower edge 14 of the front face 8 of the body 2, so that the friction surface 23 is drawn across the fabric prior to the steam vents 9 being drawn across the fabric. As the steamer head 1 is drawn in a downwardly acting motion, a section of the fabric is urged against the friction surface 23 by the air being sucked into the air inlet 16. In the present arrangement, the friction surface 23 protrudes from the front face 8 of the body 2. This helps the fabric to come into contact with the friction surface 23. However, it will be understood that the friction surface 23 may lie planar with the front face 8. The high friction coefficient between the friction surface 23 and the fabric causes the fabric to be resisted from moving relative to the steamer head 1 and so the fabric is tensioned between a garment hanger on which the garment is hung and the friction surface 23. Therefore, the section of fabric opposing the steam vents 9 is in tension as steam is applied to it, and so the fabric is stretched which enhances the ability of the steamer head to remove creases from the fabric of the garment. The high friction coefficient between the fabric of the garment and the friction surface 23 means that the tension of the fabric as the steamer head 1 is moved down the fabric is greater than that for a steamer head having a suction unit but no friction member, and so the ability of the steamer head to remove creases from the fabric is improved over such a system. Additionally, the grip of the friction surface 23 against the fabric means that less suction, and therefore less power supplied to the suction generating means, is required to achieve the same amount of tension in the fabric as a system that does not include the friction surface 23.

The amount of stretching of the fabric as the steamer head 1 is drawn across the fabric by a user is dependent on the force that the fabric is held against the steamer head 1 by the suction of the fabric attraction unit and the friction coefficient between the friction surface 23 and the fabric. The tension in the fabric is a product of the friction coefficient and the fabric attraction force. By varying the friction coefficient and the fabric attraction force, the optimum tension in the fabric can be obtained. It has been found that the steamer head 1 is particularly effective at removing wrinkles from common woven cotton fabric when the stretching force exerted on the fabric as the steamer head 1 is drawn across the fabric by a user is greater than 120 gf (1.17N). Furthermore, it has been found that if the stretching force exerted on the fabric as the steamer head 1 is drawn across the fabric by a user is greater than 250 gf (2.45N) then stretch marks may start to appear on common woven cotton fabric. Therefore, in one embodiment, the stretching force exerted on the fabric as the steamer head 1 is drawn across the fabric by a user is in the range of 120 gf (1.17N) to 250 gf (2.45N) to facilitate effective removal of wrinkles from the fabric whilst avoiding stretch marks. However, it should be recognized that steamer heads that exert a stretching force on the fabric during use that is outside the above range are also intended to fall within the scope of the invention. It should also be recognized that some fabrics such as denim could withstand higher stretching force.

Although in the above described embodiment the friction surface 23 is positioned between the steam vents 9 and the air inlet 16, it will be appreciated that the arrangement of the friction surface 23 may vary. For example, the friction surface 23 may alternatively be disposed below the air inlet 16, at the lower end of the front end 6 of the body 2. In another embodiment, the steamer head 1 comprises two or more friction members. In one such embodiment, the steam outlet 10 and/or air inlet 16 is disposed between upper and lower friction members, which will provide additional friction to grip the fabric so that it is stretched as the steamer head 1 is drawn along the fabric by the user. Although in the above described embodiment the friction surface 23 is formed by the friction member 24, in alternate embodiments the friction surface 23 is formed by other means. For example, the friction member 24 may be omitted and instead the grill 17 extending across the air inlet 16 forms the friction surface, being manufactured from a material having a high friction coefficient relative to the fabric of the garment to be steamed. In such an embodiment, the fabric is drawn against the grill 17 upon operation of the suction unit 15 and is resisted from moving relative to the steamer head 1 by the high friction material of the grill 17 when the steamer head 1 is moved in a downwards motion by the user so that the fabric is put under tension. In another embodiment, the or each friction surface 23 comprises a plurality of friction portions (not shown). The friction portions may be arranged in an array. In yet another embodiment, the front face 8 of the body 2 is formed to have a high friction coefficient. In such an embodiment, the front face 8 forms the friction surface. The front face 8 may be formed from a layer of material having a high friction coefficient with respect to the fabric to be steamed. For example, the front face 8 may be sprayed with a liquidized rubber formation that is left to harden onto said front face 8. In another such embodiment, the front face 8 comprises a soleplate manufactured from rubber or another high friction material. In one embodiment (not shown), the body 2 of the steamer head 1 is formed from a material having a high fiction coefficient with respect to the fabric to be steamed. In such an embodiment, the front face 8 of the body 2 forms the friction surface and is in direct contact with the fabric to be steamed when the steamer head 1 is moved across the fabric.

The friction member 24 on the front end 6 of the steamer head 1 may be removable. Therefore, the friction member 24 may be interchangeable with one or more alternative friction members. Therefore, friction members 24 manufactured from different materials may be used, depending on the fabric to be steamed, to ensure a high friction coefficient between the friction members 24 and the fabric. Similarly, the friction member 24 may be replaced when the friction member 24 becomes worn. It will be understood that alternative arrangements of the friction surface 23 may also be removable.

Although in the above described embodiments the high friction coefficient between the friction surface 23 and the fabric is achieved by manufacturing the friction surface 23 from a material having a certain physical property, for example, a material with a high tackiness, in alternate embodiments (not shown) the high friction coefficient may be achieved by providing the friction member 24 with a textured surface that forms the friction surface 23. For example, the friction member 24 may comprise a series of protrusions or grooves or gaps that engage with the surface of the fabric as the steamer head 1 is drawn along the fabric to increase the friction therebetween.

Figure 4:
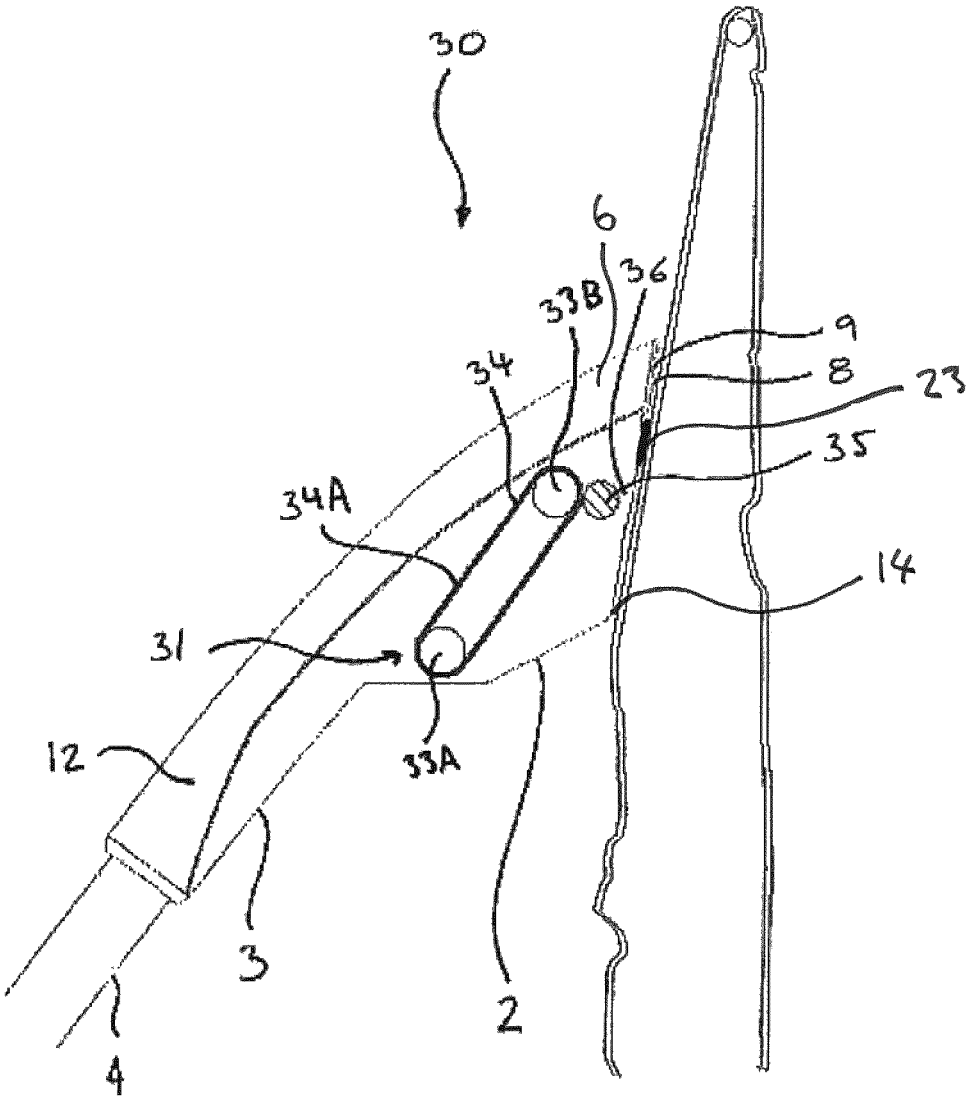
FIG. 4 shows a cross-sectional side view of another embodiment of a hand-held steamer head, located against a fabric.

Referring to FIG. 4, another embodiment of a steamer head 30 is shown. The steamer head 30 shown in FIG. 4 generally has the same arrangement as the steamer head 1 described above with reference to FIGS. 1 to 3. Therefore, a detailed description will be omitted herein. Furthermore, components and features corresponding to components and features described in the foregoing embodiments will retain the same reference numerals. However, in this embodiment the fabric attraction unit comprising a suction unit is omitted and is replaced with an alternative fabric attraction unit comprising an electrostatic generator 31. In one embodiment, the electrostatic generator 31 comprises first and second drums 33A, 33B and a sheet of flexible material 34. The first drum 33A is coupled to a motor (not shown) and the second drum 33B is positioned so that its axis is parallel to the axis of the first drum 33A. The sheet of material 34 is joined at distal ends to form a belt 34A. The first and second drums 33A, 33B are disposed within the belt 34A so that when the motor is powered to rotate the first drum 33A, the belt 34A is rotated to move over the drums 33A, 33B in a manner similar to a conveyor belt.

The electrostatic generator 31 further comprises an electrode 35 that is disposed proximate to the front face 8 of the body 2, towards the lower edge 14 thereof. The electrode 35 is positioned so that the belt 34A rubs against the electrode 35 when the first drum 33A is powered to rotate the belt 34A.

The belt 34A is manufactured from a material that is higher in the triboelectric series than the material of the electrode 35. For example, the electrode 35 may be manufactured from polypropylene and the belt 34A manufactured from nylon or the electrode 35 may be manufactured from silk and the belt 34A manufactured from polyester. Therefore, when the belt 34A is rubbed against the electrode 35 due to rotation of the first drum 33A, the belt 34A becomes positively electrostatically charged and the electrode 35 becomes negatively electrostatically charged.

The electrode 35 is insulated from the body 2, for example, by providing a gap 36 between the electrode 35 and the front end 6 of the body 2 to prevent dissipation of the electrostatic charge of the electrode 35.

Operation buttons (not shown) actuate the steam generating unit and the motor of the electrostatic generator 31 so as to cause the flow of steam out of the steam vents 9 and the electrode 35 to become electrostatically charged. The flow of steam through the steam vents 9 and the electrostatic charging of the electrode 35 may be operated independently or concurrently.

Operation of the fabric steamer 30 is generally the same as the fabric steamer 1 described above with reference to FIGS. 1 to 3 and so a detailed description will be omitted.

The electrostatic generator 31 is operated to rub the belt 34A against the electrode 35 to negatively electrostatically charge the electrode 35. The fabric of the garment proximate to the steamer head 30 is attracted to the negatively electrostatically charged electrode 35 and so the fabric is drawn against the front face 8 of the body 2.

As the fabric of the garment is drawn towards the front face 8, the fabric is held against the front face 8 by the electrostatic charge of the electrode 35. Steam vented from the steam outlet 10 is therefore expelled from the steam outlet 10, directly against the fabric and is forced through the fabric or between the fabric and the front face 8.

The user then draws the steamer head along the fabric in a downwardly acting motion in the direction of the lower edge 14 of the front face 8 of the body 2, so that the portion of the front face 8 that is proximate to the electrode 35 is drawn across the fabric prior to the steam vents 9 and friction surface 23 being drawn across the fabric. As the steamer head 30 is drawn in a downwardly acting motion, with a section of the fabric being drawn against the front face 8 of the body 2, the fabric is urged against the friction surface 23, formed by the friction member 24, by the attraction of the fabric to the negatively electrostatically charged electrode 35. As with the steamer head 1 described above with reference to FIGS. 1 to 3, the high friction coefficient between the friction surface 23 and the fabric causes the fabric to be resisted from moving relative to the steamer head 30 by the friction surface 23 so that is the fabric is under tension. Therefore, the section of fabric opposing the steam vents 9 is in tension as steam is applied to it, which enhances the ability of the steamer head 30 to remove creases from the fabric of a garment.

The high friction coefficient between the fabric of the garment and the friction surface 23 increases the tension of the fabric.

The amount of stretching of the fabric as the steamer head 30 is drawn across the fabric by a user is dependent on the force that the fabric is held against the steamer head 30 by the electrostatic force generated by the fabric attraction unit and the friction coefficient between the friction surface 23 and the fabric.

In one embodiment, the handle 3 of the hand-held steamer head 30 is earthed to prevent the build up of an electrostatic charge which could otherwise electrostatically shock the user. In one such embodiment (not shown), the handle 3 comprises a conductive material, for example, metal, conductive rubber, metal rubber or conductive silicone that is electrically connected to an earthing point by a wire. The wire may extend along the flexible hose 4. In use, when the electrostatic generator 31 is operated, static charge is prevented from building up in the conductive handle 3 as any charge in the handle 3 will flow to earth through the wire. Therefore, the user, who holds the steamer head 1 by the handle 3, is prevented from becoming electrostatically charged by the electrostatic generator 31, which may otherwise result in the user receiving an electrostatic shock if they subsequently touch an object that is earthed.

Although in the above described embodiments the steamer head 1, 30 comprises a fabric attraction unit that is configured to draw the fabric against the front end of the body, in an alternate embodiment (not shown) the fabric attraction unit is omitted. In such an embodiment, the fabric is urged against the front end of the body by the force of the user urging the front end of the steamer head towards the fabric. The arrangement of this embodiment is generally the same as the embodiments described above and so a detailed description will be omitted herein.

With such an arrangement, the user holds the steamer head by the handle so that the front end of the body extends away from the user's body. The fabric to be treated is hung from a garment hanger, such that the fabric hangs from the garment hanger in a vertical orientation, and the user urges the steamer head against the fabric. It will be appreciated that the garment may be arranged and supported in other orientations.

The user then actuates the steam generating unit. Upon operation, steam generated by the steam generation unit is supplied to the steamer head and flows out of the plurality of steam vents towards the fabric disposed proximate thereto.

As the user urges the front end of the body against the fabric, steam vented from the steam vents is expelled therefrom directly against the fabric and is forced through the fabric or between the fabric and the front face of the body. The fabric is also urged against the friction surface at the front end of the body.

The user then draws the steamer head along the fabric in a downwardly acting motion in the direction of the lower edge of the front face, so that the friction surface is drawn across the fabric prior to the steam outlet being drawn across the fabric. When the user draws the steamer head along the fabric, the user also urges the front end of the steamer head against the fabric so that the fabric is urged against the steamer head. When the fabric is hung in a vertical oreintation and the steamer head is positioned below the garment hanger by the user, the weight of the fabric will also cause the fabric to be urged against the steamer head due to the effect of gravity.

As the steamer head is drawn in a downwardly acting motion, with a section of the fabric being urged against the front face of the body by the force of the user urging the steamer head against the fabric, the fabric is urged against the friction surface formed by the friction member. As with the steamer head 1 described above with reference to FIGS. 1 to 3, the high friction coefficient between the friction member and the fabric causes the fabric to be resisted from moving relative to the steamer head by the friction member so that the fabric is tensioned between a garment hanger on which the garment is hung and the friction member. Therefore, the section of fabric opposing the steam vents is in tension as steam is applied to it, which enhances the ability of the steamer head to remove creases from the fabric of the garment.

The high friction coefficient between the fabric of the garment and the friction member means that the tension of the fabric as the steamer head is moved down the fabric is maximised, and so the ability of the steamer head to remove creases from the fabric is improved.

The amount of stretching of the fabric as the steamer head is drawn across the fabric by a user is dependent on the force with which the user urges the steamer head against the fabric and the friction coefficient between the friction member and the fabric.

Although in the above described embodiments steam is provided to the steamer head through a steam inlet, and the steam is generated in the steam generation unit, it will be appreciated that steam may be provided to the steam outlet in an alternative manner. In a further embodiment of a steamer head for a fabric steamer, the steamer head comprises a water inlet which is fluidly connected to a water supply hose. The water inlet communicates with a fluid passageway which extends in the housing of the steamer head, between the water inlet and the steam outlet. A heating means in the form of a heating element is disposed in the fluid passageway. As water supplied to the fluid passageway flows along the fluid passageway to the steam outlet the water comes into contact with and is heated by the heating means and turned into steam. Therefore, the steam flows out of the steam outlet.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A hand-held steamer head for a fabric steamer, comprising:

a body with one or more steam vents; and a friction surface for locating against a fabric to be steamed, wherein the friction surface comprises at least one friction member of a high-friction material that includes at least one of (i) a friction member integrally formed with the body, (ii) a friction member adhered to the body, and (iii) a friction member removably mounted to the body, and wherein the high-friction material of the at least one friction member acts on said fabric to increase (i) a grip against and (ii) a resistance to movement of the fabric relative to the body as the body is drawn over and against said fabric which is greater than a surface with no friction member.

2. The hand-held steamer head according to claim 1, wherein the body comprises a front end, and wherein the friction surface and the one or more steam vents are on the front end.

3. The hand-held steamer head according to claim 2, comprising a handle that is configured to orientate the front end of the body so that the fabric is drawn against the friction surface prior to passing proximate to the one or more steam vents when the body is drawn over the fabric.

4. The hand-held steamer head according to claim 2, wherein the friction surface comprises one friction member.

5. The hand-held steamer head according to claim 4, wherein the friction member protrudes from the front end of the body.

6. The hand-held steamer head according to claim 2, wherein the friction surface comprises the front end of the body.

7. The hand-held steamer head according to claim 1, wherein the friction surface has a friction coefficient to cotton fabric of greater than or equal to 0.6, or greater than 1.0, and the friction surface is formed from rubber.

8. The hand-held steamer head according to claim 1, wherein the friction surface is removably mounted to the body.

9. The hand-held steamer head according to claim 1, further comprising a fabric attraction unit configured to draw the fabric against the body.

10. The hand-held steamer head according to claim 9, wherein the friction surface is configured to exert a stretching force on the fabric which is dependent on (i) the force that the fabric is urged against the body by the fabric attraction unit and (ii) the friction coefficient between the friction surface and the fabric, wherein when the fabric is cotton the stretching force is between 120 gf (1.17N) and 250 gf (2.45N) when the hand-held steamer head is drawn over the fabric.

11. The hand-held steamer head according to claim 9, wherein the friction surface is disposed between the one or more steam vents and the fabric attraction unit.

12. The hand-held steamer head according to claim 9, wherein the fabric attraction unit comprises a suction unit having an air inlet.

13. A hand-held steamer head comprising:

a body with one or more steam vents; and a friction surface for locating against a fabric to be steamed, the friction surface being configured to act on said fabric to resist movement of the fabric relative to the body as the body is drawn over said fabric; and a fabric attraction unit configured to draw the fabric against the body, wherein the fabric attraction unit comprises an electrostatic generator.

14. The hand-held steamer head according to claim 1, wherein the friction surface comprises two or more friction surfaces.

15. A fabric steamer comprising a hand-held steamer head according to claim 1.

16. The hand-held steamer head according to claim 13, wherein the friction surface comprises at least one friction member.

17. The hand-held steamer head according to claim 16, wherein the at least one friction member protrudes from a front end of the body.

18. The hand-held steamer head according to claim 13, wherein the friction surface comprises a front end of the body.

19. The hand-held steamer head according to claim 13, wherein the friction surface has a friction coefficient to cotton fabric of greater than or equal to 0.6, and the friction surface is formed from rubber.

20. The hand-held steamer head according to claim 13, wherein the friction surface is removably mounted to the body.

* * * * *